US011509090B2

(12) United States Patent
Masuda et al.

(10) Patent No.: US 11,509,090 B2
(45) Date of Patent: Nov. 22, 2022

(54) ELECTRICAL CONNECTOR WITH BULGING PORTION AT A BEND TO DISCHARGE WATER

(71) Applicant: Yazaki Corporation, Tokyo (JP)

(72) Inventors: Satoki Masuda, Shizuoka (JP); Yasukazu Chikamatsu, Shizuoka (JP); Ayumu Ishikawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/395,625

(22) Filed: Aug. 6, 2021

(65) Prior Publication Data

US 2022/0052479 A1 Feb. 17, 2022

(30) Foreign Application Priority Data

Aug. 13, 2020 (JP) ..... JP2020-136542

(51) Int. Cl.
*H01R 13/52* (2006.01)
*H01R 24/66* (2011.01)
*H01R 13/6581* (2011.01)

(52) U.S. Cl.
CPC ..... *H01R 13/5202* (2013.01); *H01R 13/6581* (2013.01); *H01R 24/66* (2013.01); *H01R 13/5219* (2013.01); *H01R 13/5227* (2013.01)

(58) Field of Classification Search
CPC ..... H01R 13/5202; H01R 13/6581; H01R 24/66; H01R 13/5219; H01R 13/5227
See application file for complete search history.

(56) References Cited

U.S. PATENT DOCUMENTS

2017/0302019 A1 10/2017 Horiuchi et al.

FOREIGN PATENT DOCUMENTS

JP 2014099255 A * 5/2014 ..... H01R 13/5202
JP 2016-071982 A 5/2016

* cited by examiner

*Primary Examiner* — Abdullah A Riyami
*Assistant Examiner* — Justin M Kratt
(74) *Attorney, Agent, or Firm* — Sughrue Mion, PLLC

(57) ABSTRACT

A connector includes: a terminal fitting; a housing containing the terminal fitting inside and provided with a fitting portion inserted and fitted into inside of a hole-shaped counterpart fitting portion of a counterpart wall member; and a shield shell including a cylindrical portion covering, from outside, a projecting portion of the housing projecting from the counterpart fitting portion, a flange portion projecting outer than an outer circumferential surface of the cylindrical portion and a fixed portion bent from an end portion of the flange portion and fixed on an end surface of the counterpart wall member. The shield shell is provided with a bent portion between the flange portion and the fixed portion, and a bulging portion including an inner wall surface positioned inside a curve of the bent portion at an end portion in an extending direction of a bending line of the bent portion.

8 Claims, 6 Drawing Sheets

ELECTRICAL CONNECTOR WITH BULGING PORTION AT A BEND TO DISCHARGE WATER

CROSS-REFERENCE TO RELATED APPLICATION(S)

The present application claims priority to and incorporates by reference the entire contents of Japanese Patent Application No. 2020-136542 filed in Japan on Aug. 13, 2020.

BACKGROUND OF THE INVENTION

1. Field of the Invention

The present invention relates to a connector.

2. Description of the Related Art

In conventional art, as a connector, shield connectors are known. Each of shield connectors includes a housing including a fitting portion inserted and fitted into a hole-shaped counterpart fitting portion provided in a counterpart wall member, and a shield shell covering a portion of the housing projecting from the counterpart fitting portion from outside. In the connector, the shield shell is fixed to the counterpart wall member. For example, a known example of the shield shell includes a cylindrical portion covering the projecting portion of the housing from outside, a flange portion disposed opposite to a wall surface of the counterpart wall member, and a fixed portion bent from an end portion of the flange portion and fixed to the end surface of the counterpart wall member. A connector of this type is disclosed in, for example, Japanese Patent Application Laid-open No. 2016-71982.

In such a conventional connector, when liquid, such as water, exists inside the curve of the bent portion between the flange portion and the fixed portion in the shield shell, the liquid may flow into a space between the fitting portion and the counterpart fitting portion via a space between the flange portion and the wall surface of the counterpart wall member. For example, in the connector of Japanese Patent Application Laid-open No. 2016-71982, a liquid draining through hole is provided in a portion of the flange portion or the fixed portion adjacent to the bent portion, to prevent accumulation of the liquid inside the curve of the bent portion. However, in the connector, the liquid positioned inside the curve of the bent portion may enter the space between the flange portion and the wall surface of the counterpart wall member before the liquid goes outside through the through hole.

SUMMARY OF THE INVENTION

For this reason, an object of the present invention is to provide a connector promoting discharge of liquid positioned inside the curve of the bent portion.

In order to achieve the above mentioned object, a connector according to one aspect of the present invention includes a terminal fitting attached to a terminal of an electrical wire; a housing containing the terminal fitting inside and provided with a fitting portion inserted and fitted into inside of a hole-shaped counterpart fitting portion of a counterpart wall member; and a shield shell including a cylindrical portion, a flange portion, and a fixed portion, the cylindrical portion covering, from outside, a projecting portion of the housing projecting from the counterpart fitting portion on a side opposite to an insertion direction of the fitting portion into the counterpart fitting portion, the flange portion projecting outer than an outer circumferential surface of the cylindrical portion and disposed opposite to a wall surface of the counterpart wall member with a space therebetween, the fixed portion being bent from an end portion of the flange portion and fixed on an end surface of the counterpart wall member, wherein the shield shell is provided with a bent portion between the flange portion and the fixed portion, and a bulging portion including an inner wall surface positioned inside a curve of the bent portion at an end portion in an extending direction of a bending line of the bent portion and extruded largely toward outside of the curve as the bent portion extends toward an end in the extending direction.

According to another aspect of the present invention, in the connector, it is desirable that the inner wall surface of the bulging portion has a section orthogonal to the extending direction and having an arc shape.

According to still another aspect of the present invention, in the connector, it is desirable to further include an annular water stop member attached to the flange portion and pressed between the flange portion and the wall surface of the counterpart wall member.

According to still another aspect of the present invention, in the connector, it is desirable that the bent portion is provided with a through hole causing inside and outside thereof to communicate with each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a connector according to the present invention will be described hereinafter in detail with reference to the accompanying drawings. The present invention is not limited to the embodiment.

Embodiment

An embodiment of a connector according to the present invention will be described on the basis of FIG. 1 to FIG. 4.

Figure 1:
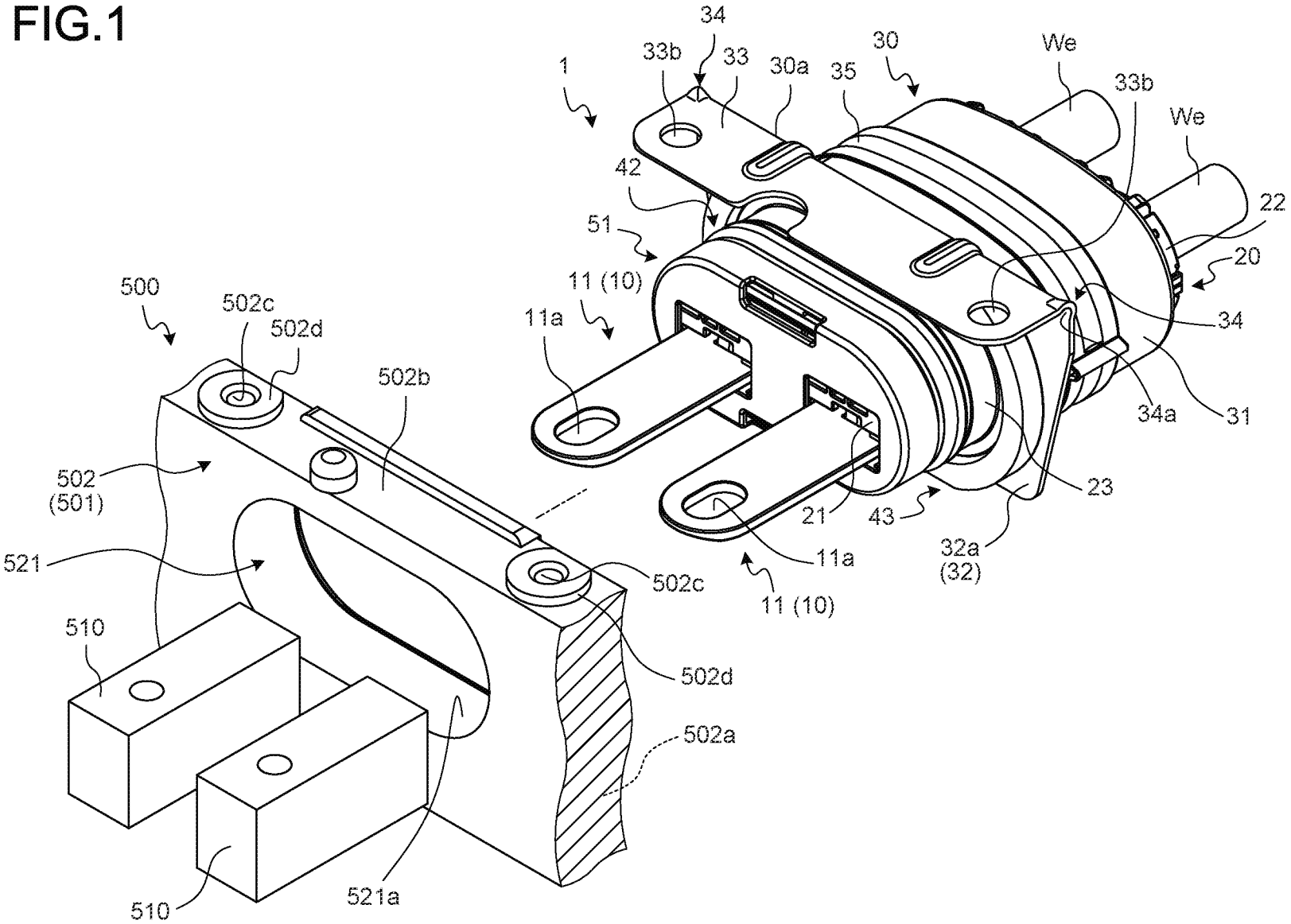
FIG. 1 is a perspective view illustrating a connector according to an embodiment.
Figure 2:
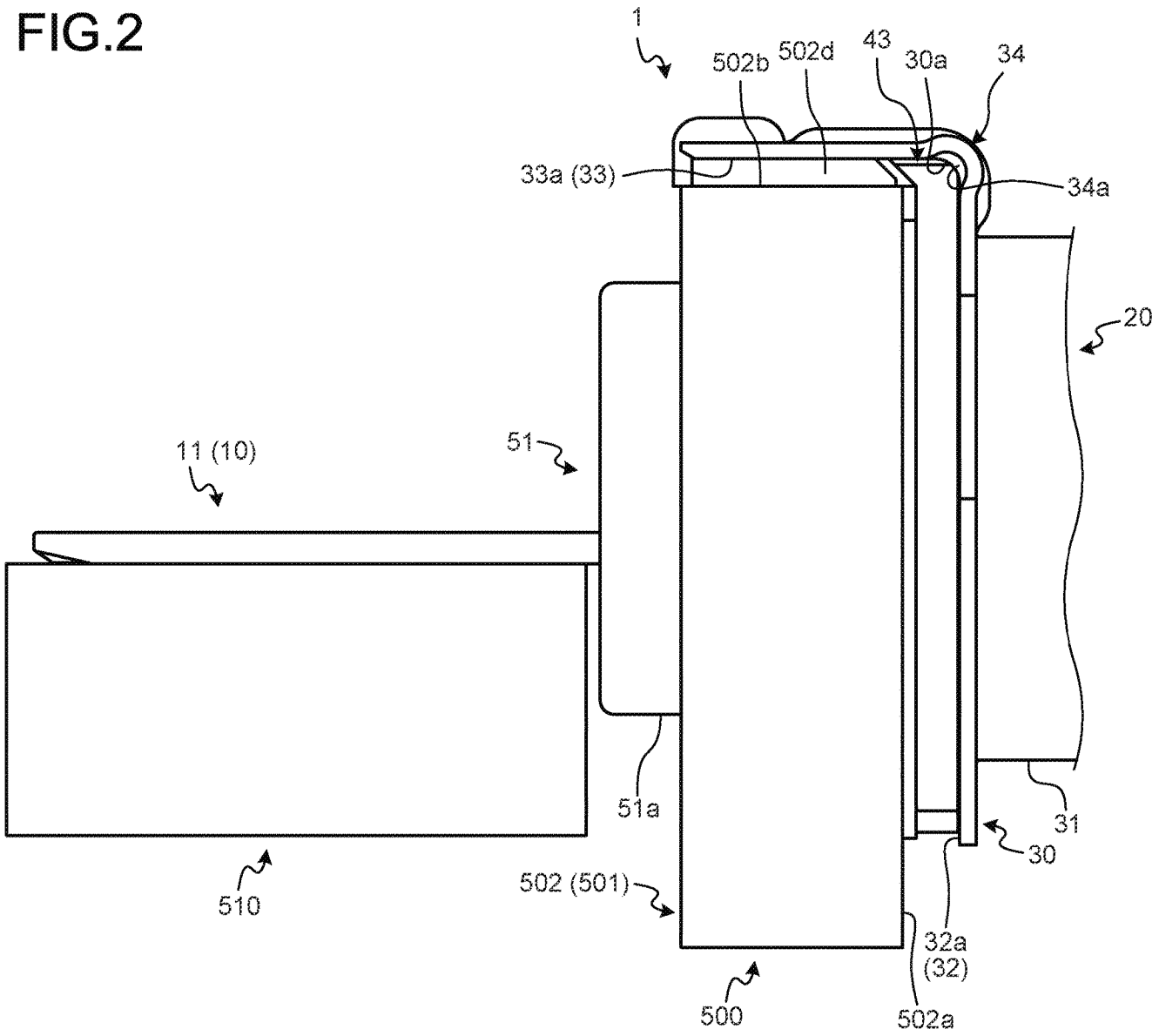
FIG. 2 is a plan view of the connector according to the embodiment as viewed from side.
Figure 3:
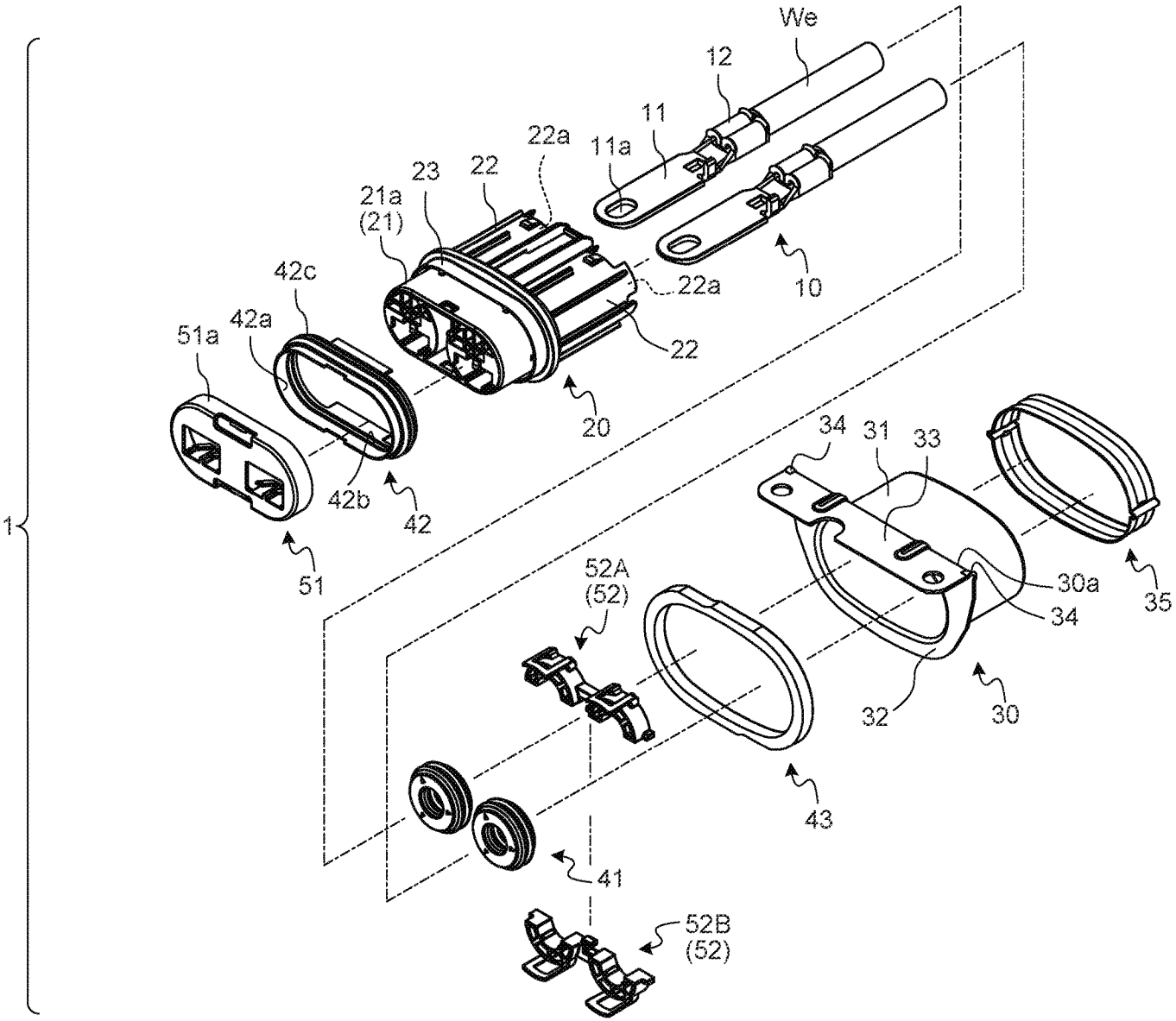
FIG. 3 is an exploded perspective view illustrating the connector according to the embodiment.
Figure 4:
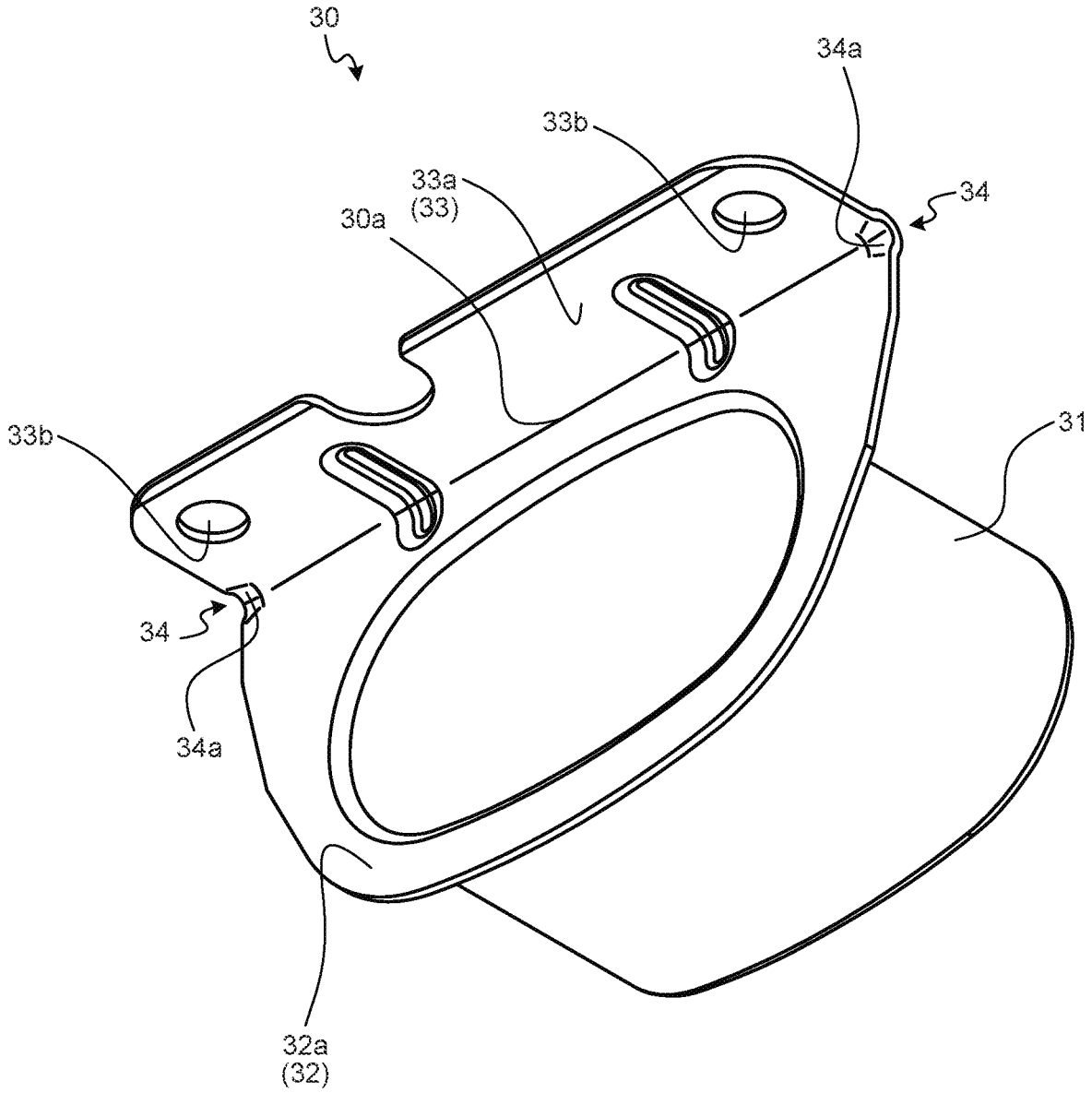
FIG. 4 is a perspective view illustrating a shield shell according to the embodiment.

Reference numeral 1 in FIG. 1 to FIG. 3 denotes a connector according to the present embodiment. The connector 1 is inserted and fitted into the inside of a hole-shaped counterpart fitting portion 521 including an inner circumferential wall surface 521*a*, and electrically connected with counterpart terminal fittings 510 (FIG. 1). The connector 1 is inserted into and extracted from the hole-shaped counterpart fitting portion 521 along a hole axis direction of the counterpart fitting portion 521. The counterpart fitting portion 521 is formed with, for example, a circular or oval section orthogonal to the hole axis direction.

For example, the connector 1 is electrically connected with the counterpart terminal fittings 510 of a counterpart apparatus 500 to electrically connect the counterpart apparatus 500 with an apparatus (not illustrated) connected with electrical wires We (FIG. 1). The counterpart apparatus 500 includes a housing 501 formed of metal, and a through hole formed in a wall member (hereinafter referred to as "counterpart wall member") 502 of the housing 501 is used as the counterpart fitting portion 521. The counterpart fitting portion 521 has a hole axis direction being a direction orthogonal to a planar wall surface 502*a* (FIG. 1) of the counterpart wall member 502, and the connector 1 is inserted and extracted along the hole axis direction. The counterpart apparatus 500 also includes a terminal block or a counterpart connector (not illustrated) inside the housing 501. The counterpart terminal fittings 510 are included in the terminal block or the counterpart connector. Accordingly, the connector 1 is inserted and fitted into the inside of the counterpart fitting portion 521, and electrically connected with the counterpart terminal fittings 510 of the terminal block or the counterpart connector inside the housing 501.

In the following description, when the term "insertion direction" is simply used without any special reference, the term "insertion direction" indicates the insertion direction of the connector 1 with respect to the counterpart fitting portion 521. When the term "extraction direction" is simply used without any special reference, the term "extraction direction" indicates the extraction direction of the connector 1 with respect to the counterpart fitting portion 521. In addition, when the term "insertion/extraction direction" is simply used without any special reference, the term "insertion/extraction direction" indicates the insertion/extraction direction of the connector 1 with respect to the counterpart fitting portion 521.

The connector 1 includes terminal fittings 10, a housing 20, and a shield shell 30 (FIG. 1 and FIG. 3).

The terminal fittings 10 are formed of a conductive material, such as metal. For example, the terminal fittings 10 are formed in a predetermined shape by press-forming, such as folding and cutting, for a metal plate serving as the base material. The terminal fittings 10 are attached to terminals of the electrical wires We to be electrically connected with the electrical wires We. The terminal fittings 10 are electrically connected with the counterpart terminal fittings 510. For this reason, the terminal fittings 10 include terminal connecting portions 11 physically and electrically connected with the counterpart terminal fittings 510, and electrical wire connecting portions 12 physically and electrically connected with the terminals of the electrical wires We (FIG. 3).

Each of the terminal connecting portions 11 illustrated herein is formed in a piece member shape (FIG. 1 and FIG. 3). Each of the terminal connecting portions 11 is provided with a through hole 11*a*. The terminal connecting portions 11 are, for example, screwed to the counterpart terminal fittings 510 via the through holes 11*a* and thereby physically and electrically connected with the counterpart terminal fittings 510. The connection form of the terminal fittings 10 and the counterpart terminal fittings 510 is not necessarily such a screwing structure. For example, the terminal fittings 10 and the counterpart terminal fittings 510 may have mutually fittable shapes, one of them may be formed in a female terminal shape, and the other may be formed in a male terminal shape.

The electrical wire connecting portions 12 are, for example, crimped or welded to core wires of the terminals of the electrical wires We and thereby physically and electrically connected with the electrical wires We. Each of the electrical wire connecting portions 12 illustrated herein is crimped to the core wire by caulking a bare core wire with two barrel pieces.

Each of the illustrated terminal fittings 10 is formed in a straight shape in which the terminal connecting portion 11 and the electrical wire connecting portion 12 are arranged in a straight line. For this reason, the electrical wire We is drawn out of the electrical wire connecting portion 12 in an extending direction of the terminal fitting 10 extending along the straight line. The terminal fitting 10 may have a structure in which the terminal connecting portion 11 and the electrical wire connecting portion 12 are arranged to cross each other, and for example, they are arranged orthogonally.

The connector 1 illustrated herein includes two pairs each of which is formed of the terminal fitting 10 and the electrical wire We.

The housing 20 is formed of an insulating material, such as synthetic resin. The housing 20 contains the terminal fittings 10 and the electrical wires We inside. In the housing 20, the terminal fittings 10 are retained in a contained state, and the electrical wires We are drawn out from the inside to the outside.

The housing 20 includes a fitting portion 21 containing the terminal fittings 10 inside and to be inserted and fitted into the inside of the hole-shaped counterpart fitting portion 521 of the counterpart wall member 502 (FIG. 1 and FIG. 3). The fitting portion 21 is inserted and fitted into the inside of the counterpart fitting portion 521 along the insertion direction, and extracted from the inside of the counterpart fitting portion 521 along the extraction direction opposite to the insertion direction. The fitting portion 21 is formed in a cylindrical shape having a cylinder axis direction being the insertion/extraction direction (insertion direction, extraction direction) with respect to the counterpart fitting portion 521. For this reason, in the following description, the term "cylinder axis direction" is also used instead of the insertion/extraction direction. The fitting portion 21 illustrated herein has a section orthogonal to the cylinder axis and having an oval cylindrical shape, and the two terminal fittings 10 are arranged in parallel in the longitudinal direction of the oval. The fitting portion 21 illustrated herein retains the terminal connecting portions 11 inside, and end portions of the terminal connecting portions 11 on the through hole 11*a* side project from the inside to the outside. The fitting portion 21 illustrated herein contains therein portions of the terminal connecting portions 11 on the electrical wire connecting portion 12 side and portions of the electrical wire connecting portions 12 on the terminal connecting portion 11 side. The inside of the fitting portion 21 is provided with a partition wall (not illustrated) between the adjacent terminal fittings 10.

In the state in which the fitting portion 21 is inserted and fitted into the inside of the counterpart fitting portion 521, a portion of the housing 20 positioned on the extraction direction side beyond the fitting portion 21 projects from the counterpart fitting portion 521. The housing 20 includes cylindrical electrical wire containing portions 22 containing the electrical wires We inside, as the projecting portion projecting from the counterpart fitting portion 521 on the extraction direction side (FIG. 1 and FIG. 3). The electrical wire containing portions 22 illustrated herein are each formed in a cylindrical shape and are provided for the respective electrical wires We. The electrical wire containing portions 22 are arranged in the arrangement direction of the two terminal fittings. The housing 20 includes a cylindrical portion 23 between the fitting portion 21 and the electrical wire containing portions 22. The cylindrical portion 23 is coaxial with the cylindrical axis of the fitting portion 21 and provided outer than an outer circumferential wall surface 21*a* of the fitting portion 21. The cylindrical portion 23 illustrated herein has a section orthogonal to the cylindrical axis and having an oval cylindrical shape, and is disposed with an annular space with respect to the outer circumferential wall surface 21*a* of the fitting portion 21.

In the housing 20, the electrical wires We provided with the terminal fittings 10 are inserted through openings 22*a* of the electrical wire containing portions 22 (FIG. 3). Accordingly, the electrical wires We are drawn out of the openings 22*a* to the outside. In this state, an annular space is formed between the electrical wire containing portion 22 and the electrical wire We. For this reason, in the connector 1, the electrical wire We is inserted through an annular water stop member (hereinafter referred to as "inner water stop member") 41 (FIG. 3) in advance, and the inner water stop member 41 is inserted into the electrical wire containing portion 22 together with the electrical wire We to fill the annular space between the electrical wire containing portion 22 and the electrical wire We. The inner water stop member 41 is a rubber plug.

The connector 1 includes a front holder 51 into which the distal end (end portion on the insertion direction side) of the fitting portion 21 of the housing 20 is inserted (FIG. 1 to FIG. 3). The front holder 51 maintains a retained state of the terminal fittings 10 contained together with the fitting portion 21 in the housing 20. The front holder 51 includes a cylindrical portion 51*a* having a cylindrical axis direction being the insertion/extraction direction, and the distal end of the fitting portion 21 is inserted into the inside of the cylindrical portion 51*a* (FIG. 3). The cylindrical portion 51*a* illustrated herein has a section orthogonal to the cylindrical axis and having an oval cylindrical shape.

In the connector 1, an annular end surface of the cylindrical portion 51*a* of the front holder 51 on the extraction direction side is opposed to an end surface of the cylindrical portion 23 of the housing 20 on the insertion direction side, with a space therebetween in the insertion/extraction direction. Accordingly, in the connector 1, an annular groove is formed between the end surfaces of the cylindrical portions 23 and 51*a*, and the outer circumferential wall surface 21*a* of the fitting portion 21 serves as a groove bottom of the annular groove. In the connector 1, the annular groove is provided with an annular water stop member (hereinafter referred to as "first outer water stop member") 42 (FIG. 1 and FIG. 3).

The inner circumferential surface side of the first outer water stop member 42 is brought into close contact with the groove bottom of the annular groove, and the outer circumferential surface side of the first outer water stop member 42 is brought into close contact with the inner circumferential wall surface 521*a* of the counterpart fitting portion 521, to fill the annular space between the groove bottom of the annular groove and the inner circumferential wall surface 521*a* of the counterpart fitting portion 521. In this manner, the first outer water stop member 42 suppresses infiltration of liquid, such as water, from the space between the fitting portion 21 and the counterpart fitting portion 521 into the inside of the housing 501. For this reason, the first outer water stop member 42 is formed of an elastically deformable synthetic resin material, such as rubber.

The first outer water stop member 42 includes a cylindrical base portion 42*a*, a coaxial annular lip (hereinafter referred to as "inner circumferential lip") 42*b* formed to project from the inner circumferential surface of the base portion 42*a*, and a coaxial annular lip (hereinafter referred to as "outer circumferential lip") 42*c* formed to project from the outer circumferential surface of the base portion 42*a* (FIG. 3). In the first outer water stop member 42, a plurality of inner circumferential lips 42*b* and a plurality of outer circumferential lips 42*c* are arranged in the cylinder axis direction of the base portion 42*a*. The first outer water stop member 42 illustrated herein is provided with two inner circumferential lips 42*b* and two outer circumferential lips 42*c*. A section of the base portion 42*a* illustrated herein orthogonal to the cylinder axis is formed in an oval cylindrical shape. Each of the inner circumferential lips 42*b* and the outer circumferential lips 42*c* illustrated herein has a section orthogonal to the cylinder axis of the base portion 42*a* and having an oval annular shape.

In the connector 1, a rear holder 52 holding the electrical wires We while suppressing bending of the electrical wires We is mounted between the openings 22*a* of the electrical wire containing portion 22 and the inner water stop members 41 (FIG. 3). The illustrated rear holder 52 adopts a two-division structure including a first holder member 52A and a second holder member 52B, and holds and retains the electrical wires We between the first holder member 52A and the second holder member 52B. Each of the electrical wires We is drawn to the outside from the opening 22*a* via the rear holder 52. Although it is not described in detail, the rear holder 52 is held with the electrical wire containing portions 22 by engaging locking portions provided on each of the first holder member 52A and the second holder member 52B with hook portions provided on the electrical wire containing portions 22. Each of the first holder member 52A and the second holder member 52B is formed of an insulating material, such as synthetic resin.

The shield shell 30 suppresses entrance of noise from the outside into the electrical wires We positioned inside by covering, from outside, projecting portions (electrical wire containing portions 22) of the housing 20 projecting from the counterpart fitting portion 521 on the extraction direction side. For this reason, the shield shell 30 is formed of a metal material (for example, aluminum or an aluminum alloy). The shield shell 30 illustrated herein is press-formed, with a metal plate used as the base material.

The shield shell 30 includes a cylindrical portion 31 covering the electrical wire containing portions 22 from outside (FIG. 1 to FIG. 4). The cylindrical portion 31 has a section orthogonal to the cylinder axis and having an oval cylindrical shape, and the two electrical wire containing portions 22 are arranged in parallel along the longitudinal direction of the oval.

The shield shell 30 also includes a flange portion 32 and a fixed portion 33 (FIG. 1 to FIG. 4). The flange portion 32 is formed to project outer than the outer circumferential surface of the cylindrical portion 31, and disposed opposite to the wall surface 502*a* of the counterpart wall member 502 with a space therebetween in a state in which the fitting portion 21 is inserted and fitted into the inside of the counterpart fitting portion 521. The fixed portion 33 is bent from an end portion of the flange portion 32, and fixed on an end surface 502*b* of the counterpart wall member 502 in the state in which the fitting portion 21 is inserted and fitted into the inside of the counterpart fitting portion 521.

The flange portion 32 is coaxial with the cylinder axis of the cylindrical portion 31, and formed in an annular and planar shape projecting outer than the outer circumferential surface of the cylindrical portion 31. One flat surface 32*a* of the flange portion 32 is disposed opposite to the wall surface 502*a* of the counterpart wall member 502 with a space therebetween, in the state in which the fitting portion 21 is inserted and fitted into the inside of the counterpart fitting portion 521 (FIG. 2).

The end surface 502*b* of the counterpart wall member 502 is a flat surface orthogonally connecting to the wall surface 502*a*, and one flat surface 33*a* of the planar fixed portion 33 is disposed opposite to the end surface 502*b* in the state in which the fitting portion 21 is inserted and fitted into the inside of the counterpart fitting portion 521 (FIG. 2). The fixed portion 33 illustrated herein is bent by 90° from the end portion of the flange portion 32 to be orthogonal to the flange portion 32. The fixed portion 33 illustrated herein is fixed on the end surface 502*b* of the counterpart wall member 502 by screwing. Accordingly, the end surface 502*b* of the counterpart wall member 502 is provided with fixing portions 502*c* serving as female screw portions to fix the fixed portion 33 (FIG. 1). Each of the fixing portions 502*c* illustrated herein includes an annular spacer portion 502*d* projecting from the end surface 502*b* of the counterpart wall member 502. The flat surface 33*a* of the fixed portion 33 is offset from the end surface 502*b* of the counterpart wall member 502 by the thickness of the spacer portions 502*d*. The fixed portion 33 is provided with through holes 33*b* disposed opposite to the fixing portions 502*c* in the state in which the fitting portion 21 is inserted and fitted into the inside of the counterpart fitting portion 521 (FIG. 1). Male screw portions (not illustrated) to be screwed into the fixing portions 502*c* are inserted into the through holes 33*b*. Two pairs of the through holes 33*b* and the fixing portions 502*c* are provided in this example.

The connector 1 includes a braid (not illustrated) covering the outer circumferential surface of the cylindrical portion 31 of the shield shell 30 and the electrical wires We drawn out of the openings 22*a* of the electrical wire containing portions 22 to the outside. The braid is a member formed by plaiting a metal material in a cylindrical and net shape, and suppresses entrance of noise into the electrical wires We drawn out of the openings 22*a* to the outside. The braid is brought into close contact with the outer circumferential surface of the cylindrical portion 31 using a cylindrical connecting member 35 (FIG. 1 and FIG. 3).

In the connector 1, the first outer water stop member 42 illustrated above suppresses infiltration of liquid, such as water, into the inside of the housing 501 via the space between the fitting portion 21 and the counterpart fitting portion 521. In addition, in the connector 1, it is desirable to reduce the inflow of the liquid entering the space between the fitting portion 21 and the counterpart fitting portion 521, in view of liquid tightness between them. For this reason, the connector 1 includes an annular water stop member (hereinafter referred to as "second outer water stop member") 43 attached to the flange portion 32 of the shield shell 30 and pressed between the flange portion 32 and the wall surface 502*a* of the counterpart wall member 502 (FIG. 1 to FIG. 3).

The second outer water stop member 43 is formed of an elastically deformable synthetic resin material, such as rubber. More specifically, the second outer water stop member 43 is formed using a spongy sheet member. The second outer water stop member 43 illustrated herein is formed using ethylene-propylene diene rubber (EPDM) and coaxial with the cylindrical portion 31 of the shield shell 30, and has a section orthogonal to the cylinder axis and having an oval annular shape. An annular wall surface of the annular member of the second outer water stop member 43 on the extraction direction side serves as an attachment surface attached to the flange portion 32, and the attachment surface is bonded to the flat surface 32*a* of the flange portion 32 using an adhesive or an adhesive member (such as a double-sided tape). In the state in which the fitting portion 21 is inserted and fitted into the inside of the counterpart fitting portion 521, the second outer water stop member 43 is pressed between the flat surface 32*a* of the flange portion 32 and the wall surface 502*a* of the counterpart wall member 502, and suppresses infiltration of liquid from the outside into the space.

In addition, the connector 1 also reduces the inflow of the liquid into the space between the flat surface 32*a* of the flange portion 32 and the wall surface 502*a* of the counterpart wall member 502. This structure improves the liquid tightness with the second outer water stop member 43 provided therebetween, and further improves the liquid tightness between the fitting portion 21 and the counterpart fitting portion 521. However, in the connector 1, a portion between the flange portion 32 and the fixed portion 33 is bent in the shield shell 30. When liquid, such as water, enters the inside of the curve of a bent portion 30*a* (FIG. 1 to FIG. 4) or dew condensation occurs inside the curve of the bent portion 30*a*, the liquid may accumulate inside the curve of the bent portion 30*a*. For example, in the connector 1, liquid may flow into the inside of the curve of the bent portion 30*a* over the flat surface 33*a* in the fixed portion 33. In addition, in the connector 1, when the liquid located inside the curve of the bent portion 30*a* accumulates until it touches the second outer water stop member 43 or when the liquid accumulating inside the curve of the bent portion 30*a* flows to the second outer water stop member 43 due to traveling vibration of the vehicle or the like, the liquid may enter the space between the flat surface 32*a* of the flange portion 32 and the second outer water stop member 43, or enter the space between the wall surface 502*a* of the counterpart wall member 502 and the second outer water stop member 43.

For this reason, in the connector 1, liquid positioned inside the curve of the bent portion 30*a* is discharged to the outside. Specifically, the shield shell 30 is provided with bulging portions 34 (FIG. 1 to FIG. 4). The bulging portions 34 include inner wall surfaces positioned inside the curve of the bent portion 30*a* at end portions in an extending direction of the bending line of the bent portion 30*a* and extruded largely toward the outside of the curve as the bent portion 30*a* extends toward the ends in the extending direction.

The bulging portions 34 are regions having a function like a gutter to discharge the liquid positioned inside the curve of the bent portion 30*a* to the outside from the end portions thereof in the extending direction of the bending line. For this reason, in the bulging portions 34, as described above, the inner wall surfaces 34*a* (FIG. 1, FIG. 2, and FIG. 4) are extruded largely toward the outside of the curve as the bent portion 30*a* extends toward the ends in the extending direction such that the liquid positioned inside the curve of the bent portion 30*a* and having flowed to the inner wall surfaces 34*a* is easily discharged to the outside from the ends of the extending direction of the bending line. In this manner, the bulging portions 34 include the inner wall surfaces 34*a* inclined toward the outside of the curve with respect to the flat surface 32*a* of the flange portion 32 and/or the flat surface 33*a* of the fixed portion 33 as the bent portion 30*a* extends toward the ends in the extending direction of the bending line of the bent portion 30*a*. Accordingly, the connector 1 is enabled to discharge the liquid positioned inside the curve of the bent portion 30*a* to the outside through the bulging portions 34 before the liquid accumulates inside the curve of the bent portion 30*a*, or discharge the liquid to the outside through the bulging portions 34 even when the liquid accumulates inside the curve of the bent portion 30*a*.

The inner wall surfaces 34*a* of the bulging portions 34 may have any shape as long as the shape enables discharge of the liquid. For example, the inner wall surface 34*a* of each of the bulging portions 34 illustrated herein has an arc-shaped section orthogonal to the extending direction of the bending line of the bent portion 30*a*. The inner wall surfaces 34*a* may be formed with uniform or substantially equal radii of curvature of the arcs at positions in the extending direction of the bending line of the bent portion 30*a*, or with the radii of curvature gradually increasing toward the ends of the extending direction.

The bulging portion 34 may be provided at least one of the two end portions of the bent portion 30*a* in the extending direction of the bending line, according to the mount state thereof on the vehicle. For example, in the connector 1, when one of the end portions of the bent portion 30*a* is disposed lower than the other end portion in the vertical direction, it suffices that the bulging portion 34 is provided at least in the lower end portion of the bent portion 30*a*. As another example, in the connector 1, when the two end portions of the bent portion 30*a* are arranged in the same or substantially equal positions in the vertical direction, the bulging portion 34 should be provided in each of the two end portions.

As described above, the connector 1 according to the present embodiment includes the second outer water stop member 43 between the flange portion 32 and the wall surface 502*a* of the counterpart wall member 502. With the structure, the connector 1 enables reduction of inflow of liquid entering the space between the fitting portion 21 and the counterpart fitting portion 521 via the space therebetween. In particular, because the connector 1 is provided with the first outer water stop member 42 between the fitting portion 21 and the counterpart fitting portion 521, the connector 1 is enabled to retain liquid tightness between the fitting portion 21 and the counterpart fitting portion 521 with the first outer water stop member 42 by suppressing inflow of liquid into the space therebetween. In addition, the connector 1 according to the present embodiment includes the bulging portions 34 provided at end portions of the bent portion 30*a* of the shield shell 30, and is enabled to discharge liquid positioned inside the curve of the bent portion 30*a* to the outside through the bulging portions 34. As described above, the connector 1 according to the present embodiment is enabled to promote discharge of liquid positioned inside the curve of the bent portion 30*a* and suppress inflow of the liquid into the space between the fitting portion 21 and the counterpart fitting portion 521.

Modification

Figure 5:
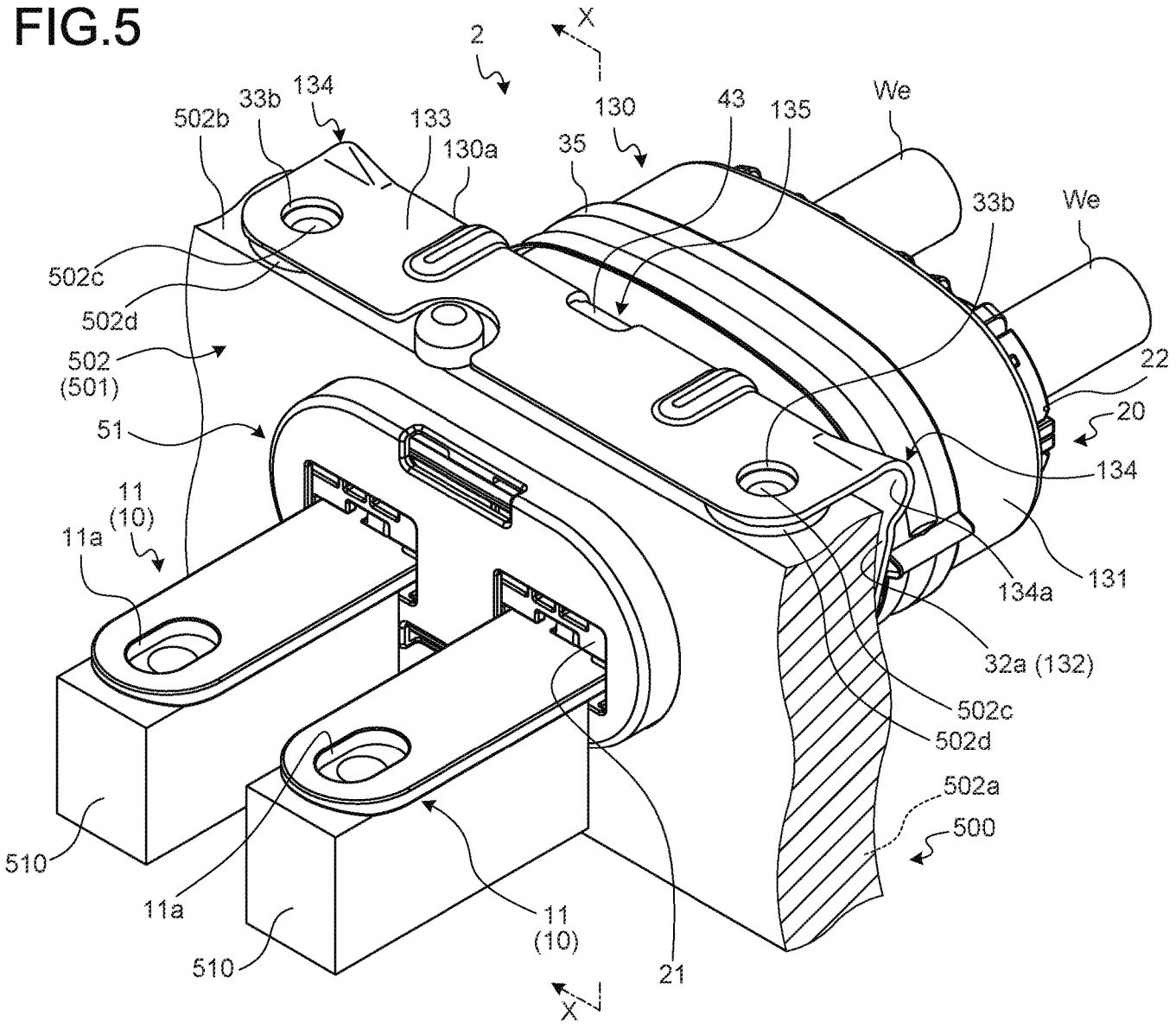
FIG. 5 is a perspective view illustrating a connector of a modification.
Figure 6:
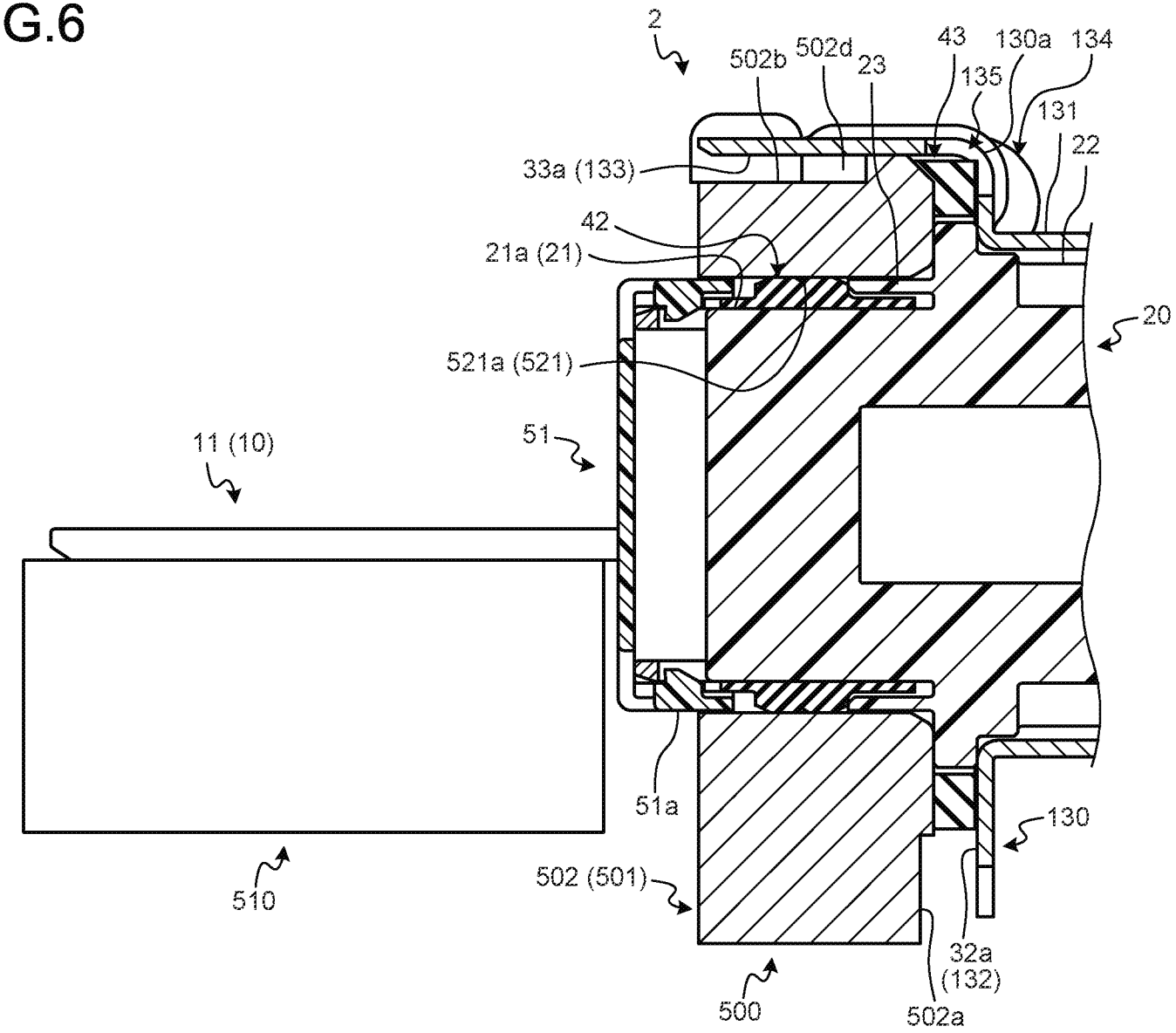
FIG. 6 is a cross-sectional view taken along line X-X of FIG. 5.

Reference numeral 2 in FIG. 5 and FIG. 6 denotes a connector of the present modification. The connector 2 corresponds to a structure acquired by replacing the shield shell 30 by the following shield shell 130 in the connector 1 according to the embodiment described above. The shield shell 130 according to the present modification corresponds to a structure acquired by partly changing the shape of the shield shell 30 according to the embodiment. For this reason, in the following description, the same reference numerals are assigned to the same components and/or regions as those of the connector 1 according to the embodiment as necessary, and a description thereof will be omitted.

The shield shell 130 according to the present modification includes a cylindrical portion 131, a flange portion 132, and a fixed portion 133 that are similar to the cylindrical portion 31, the flange portion 32, and the fixed portion 33 of the shield shell 30 according to the embodiment, respectively (FIG. 5 and FIG. 6). Accordingly, the shield shell 130 includes a bent portion 130*a* similar to the bent portion 30*a* according to the embodiment between the flange portion 132 and the fixed portion 133. In addition, the shield shell 130 according to the present modification includes bulging portions 134 similar to the bulging portions 34 of the shield shell 30 according to the embodiment (FIG. 5 and FIG. 6). The bulging portions 134 according to the present modification include inner wall surfaces 134*a* having larger extrusion quantity toward the outside of the curve than that of the bulging portions 34 according to the embodiment.

By contrast, in the shield shell 130 according to the present modification, the bent portion 130*a* is provided with a through hole 135 causing the inside and the outside thereof to communicate with each other, in addition to the bulging portions 134, to discharge liquid positioned inside the bent portion 130*a* to the outside (FIG. 5 and FIG. 6). The through hole 135 is a liquid draining hole to discharge liquid positioned inside the curve of the bent portion 130*a* to the outside. This structure enables the connector 2 according to the present modification to discharge the liquid positioned inside the curve of the bent portion 130*a* to the outside through the through hole 135 before the liquid accumulates inside the curve of the bent portion 130*a*, or discharge the liquid to the outside through the through hole 135 even when the liquid accumulates inside the curve of the bent portion 130*a*. For example, the connector 2 according to the present modification is enabled to discharge liquid positioned inside the curve of the bent portion 130*a* to the outside with a combination of the bulging portions 134 and the through hole 135. In addition, even when liquid positioned inside the curve of the bent portion 130*a* is not completely discharged to the outside through the bulging portions 134 at the end portions, the connector 2 according to the present modification is enabled to discharge the liquid that has not completely been discharged, to the outside through the through hole 135. Besides, even when liquid positioned inside the curve of the bent portion 130*a* is not completely discharged to the outside through the through hole 135, the connector 2 according to the present modification is enabled to discharge the liquid that has not completely been discharged, to the outside through the bulging portions 134 at the end portions.

The through hole 135 is desirably disposed opposite to the second outer water stop member 43 without any space therebetween in the insertion/extraction direction, and provided with a space from the second outer water stop member 43 except the oppositely disposed portion. In the connector 2, the through hole 135 and the second outer water stop member 43 are arranged opposite to each other without any space therebetween in the insertion/extraction direction. This structure enables the connector 2 to discharge, to the outside through the through hole 135, the liquid accumulating inside the curve of the bent portion 130*a* to an amount touching the second outer water stop member 43 or liquid flowing from the inside of the curve to the second outer water stop member 43, before the liquid enters the space between the flat surface 32*a* of the flange portion 132 and the second outer water stop member 43. For this reason, the through hole 135 is desirably formed to extend to the flange portion 132. In addition, in the connector 2, a space is provided between the through hole 135 and the second outer water stop member 43 except the oppositely disposed portion. This structure enables the connector 2 to discharge the liquid positioned inside the curve of the bent portion 130*a* to the outside through the space. As described above, the liquid may flow into the inside of the curve of the bent portion 130*a* over the flat surface 33*a* of the fixed portion 133. For this reason, the through hole 135 is desirably formed to extend to the fixed portion 133. This structure enables the connector 2 to discharge the liquid flowing over the flat surface 33*a* of the fixed portion 133 to the outside through the through hole 135 at an early stage.

In addition, the through hole 135 is desirably provided in a place located inside the curve of the bent portion 130*a* and having a minimum distance from the second outer water stop member 43 before the through hole 135 is provided. Because liquid most easily accumulates in such a place, providing the through hole 135 in the place enables discharge of the liquid to the outside through the through hole 135 without accumulation of the liquid inside the curve of the bent portion 130*a*.

As described above, the connector 2 according to the present modification is also provided with the through hole 135 in the bent portion 130*a* of the shield shell 130. This structure enables the connector 2 to discharge the liquid positioned inside the curve of the bent portion 130*a* to the outside through the bulging portions 134 and the through hole 135. With this structure, the connector 2 has an enhanced function of discharging liquid positioned inside the curve of the bent portion 130*a*, in comparison with the connector 1 according to the embodiment.

The connector according to the present embodiment is provided with a bulging portion at an end portion of the bent portion of the shield shell, and is enabled to discharge liquid positioned inside the curve of the bent portion to the outside from the bulging portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting attached to a terminal of an electrical wire;

a housing containing the terminal fitting inside and provided with a fitting portion inserted and fitted into an inside of a hole-shaped counterpart fitting portion of a counterpart wall member; and a shield shell including a cylindrical portion, a flange portion, and a fixed portion, the cylindrical portion covering, from outside, a projecting portion of the housing projecting from the counterpart fitting portion on a side opposite to an insertion direction of the fitting portion into the counterpart fitting portion, the flange portion projecting outer from an outer circumferential surface of the cylindrical portion and disposed opposite to a wall surface of the counterpart wall member with a space therebetween, the fixed portion being bent from an end portion of the flange portion and fixed on an end surface of the counterpart wall member, wherein the shield shell is provided with a bent portion between the flange portion and the fixed portion, and a bulging portion including an inner wall surface positioned inside a curve of the bent portion at an end portion in an extending direction of a bending line of the bent portion and extruded largely toward outside of the curve as the bent portion extends toward an end in the extending direction.

2. The connector according to claim 1, wherein the inner wall surface of the bulging portion has a section orthogonal to the extending direction and having an arc shape.

3. The connector according to claim 1, further comprising:

an annular water stop member attached to the flange portion and pressed between the flange portion and the wall surface of the counterpart wall member.

4. The connector according to claim 2, further comprising:

an annular water stop member attached to the flange portion and pressed between the flange portion and the wall surface of the counterpart wall member.

5. The connector according to claim 1, wherein the bent portion is provided with a through hole causing inside and outside thereof to communicate with each other.

6. The connector according to claim 2, wherein the bent portion is provided with a through hole causing inside and outside thereof to communicate with each other.

7. The connector according to claim 3, wherein the bent portion is provided with a through hole causing inside and outside thereof to communicate with each other.

8. The connector according to claim 4, wherein the bent portion is provided with a through hole causing inside and outside thereof to communicate with each other.

* * * * *